US005930963A

United States Patent [19]

Nichols

[11] Patent Number: 5,930,963

[45] Date of Patent: Aug. 3, 1999

[54] WALL PANEL SYSTEM

[75] Inventor: Robert K. Nichols, Muscatine, Iowa

[73] Assignee: HON Technology Inc., Muscatine, Iowa

[21] Appl. No.: 09/092,716

[22] Filed: Jun. 5, 1998

[51] Int. Cl.[6] ..... E04B 2/74; E04C 2/38

[52] U.S. Cl. ..... 52/239; 52/241; 52/36.6; 52/475.1; 52/764

[58] Field of Search ..... 52/239, 241, 36.4, 52/36.5, 36.6, 475.1, 479, 764

[56] References Cited

U.S. PATENT DOCUMENTS

| | | | |
|---|---|---|---|
| 4,086,978 | 5/1978 | Clements | 52/36.6 X |
| 4,905,428 | 3/1990 | Sykes | 52/239 X |
| 5,309,686 | 5/1994 | Underwood et al. | 52/239 X |
| 5,682,719 | 11/1997 | Huang | 52/239 X |
| 5,724,779 | 3/1998 | Chang | 52/239 |
| 5,740,650 | 4/1998 | Seiber et al. | 52/239 X |

*Primary Examiner*—Christopher Kent
*Assistant Examiner*—Brian E. Glessner
*Attorney, Agent, or Firm*—Jones, Day, Reavis & Pogue

[57] ABSTRACT

A panel system includes a rigid generally rectangular frame assembly formed from a pair of spaced upright members and a plurality of transverse members connecting the upright members. One of the transverse members is positioned intermediate the ends of the upright members and has a generally H-shaped configuration in cross-section. A generally elongate channel fits within the intermediate transverse member and has an upwardly projecting portion which is narrower in width than the transverse member. The projecting portion serves to provide for the mounting of electrical devices and also creates a light stop when decorative tiles are used to form a gap or slot in the frame assembly for passage of electrical cables and wiring into the interior of the frame assembly.

10 Claims, 4 Drawing Sheets

WALL PANEL SYSTEM

BACKGROUND OF THE INVENTION

1. Field of the Invention

The present invention relates generally to the construction of a wall panel system of the type used in open-plan office environments and, more particularly, to a wall panel system having a unique frame construction which is highly functional and readily manufacturable.

2. Description of the Related Art

Open-plan office wall partition systems have gained wide acceptance in the construction of modern office space. These systems generally comprise modular panel assemblies connected in configurations which divide or partition the work space into office cubicles suitable for varieties of specific tasks. The panels are often constructed with a steel framework covered by decorative tiles meant to compliment the decor of the office space. The panel assemblies may be designed to support cabinets, shelves, desk surfaces and the like. Hence, they must be designed in a manner as to be relatively rigid and sturdy. Often the wall panels are hollow and contain provisions for accommodating electrical devices and cables.

A disadvantage of known modular panels for use in office partition systems is that they are frequently constructed with complex steel members in order to achieve rigidity and also to provide for the mounting of electrical devices and the routing of electrical cables. In one form of system it is known to use what is referred to as a "beltline" wire management arrangement. In such a system cables are routed to feed electrical connectors and receptacles mounted within the panels at approximately the height of a desk top so that they can be accessible to desk top electrical equipment such as computers or the like. It is common in such systems to provide a horizontal opening or slot in the associated decorative tile system for routing of cables into the interior of panels. In order to prevent the slots from being open on both sides of the panel a special tile is used adjacent the slot having a foam or rubber gasket to essentially close the slot and prevent light passage through the panel. Such an arrangement adds expense to the construction of the panel system.

SUMMARY OF THE INVENTION

The present invention improves over the prior art by providing a modular wall panel system comprising a rigid generally rectangular frame assembly formed from a pair of spaced upright members and a plurality of transverse members connecting the upright members. One of the transverse members is positioned intermediate the ends of the upright members and has a generally H-shaped configuration in cross-section. A generally elongate channel fits within the intermediate transverse member and has an upwardly projecting portion which is narrower in width than the transverse member. The projecting portion serves to provide for the mounting of electrical devices and also creates a light stop when decorative tiles are used to form a gap or slot in the frame assembly for passage of electrical cables and wiring into the interior of the frame assembly.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
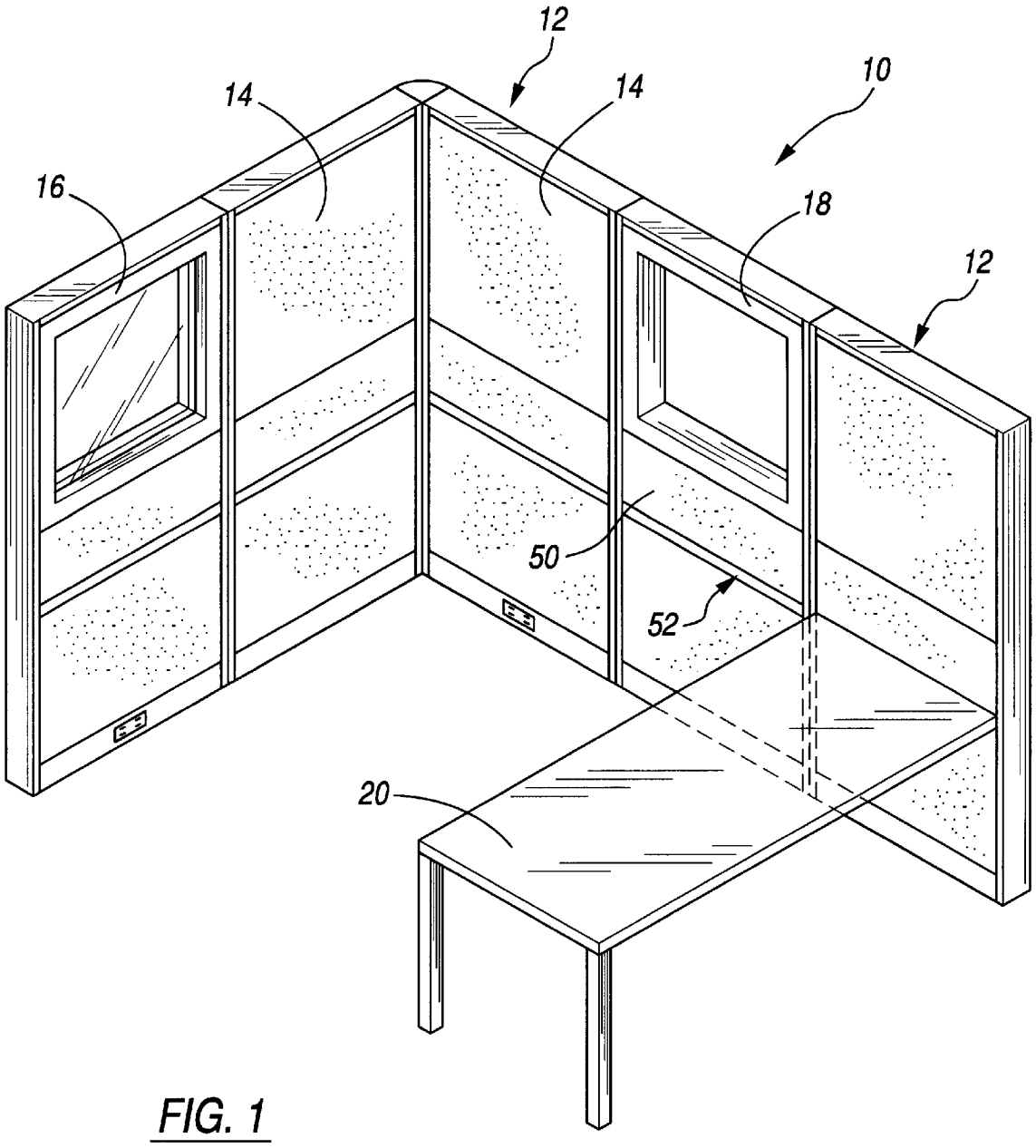
FIG. 1 is a perspective view of one form of a modular wall panel system using frame assemblies constructed in accordance with the principles of the invention.

Referring now to the drawings and initially to FIG. 1, a form of a modular wall panel system suitable for use in open-plan office arrangements is designated generally by the reference numeral 10. The system 10 is constructed of individual panel assemblies 12 joined end-to-end at their edges by suitable fastening means which typically includes bolts. In the illustrated system 10, the panel assemblies are shown with decorative tiles 14 which may be secured in place using clips, hooks or the like. These decorative tiles 14 may advantageously be constructed of fiberboard panels covered with a fabric material that complements the decor of the associated office space. One form of panel assembly 12 may include a window assembly 16 to provide light to the system 10. Another form of panel assembly 12 may include an open pass-through 18. In a manner which will be described hereinafter in detail a work surface 20 may be supported at one or more ends from a panel assembly 12.

Figure 2:
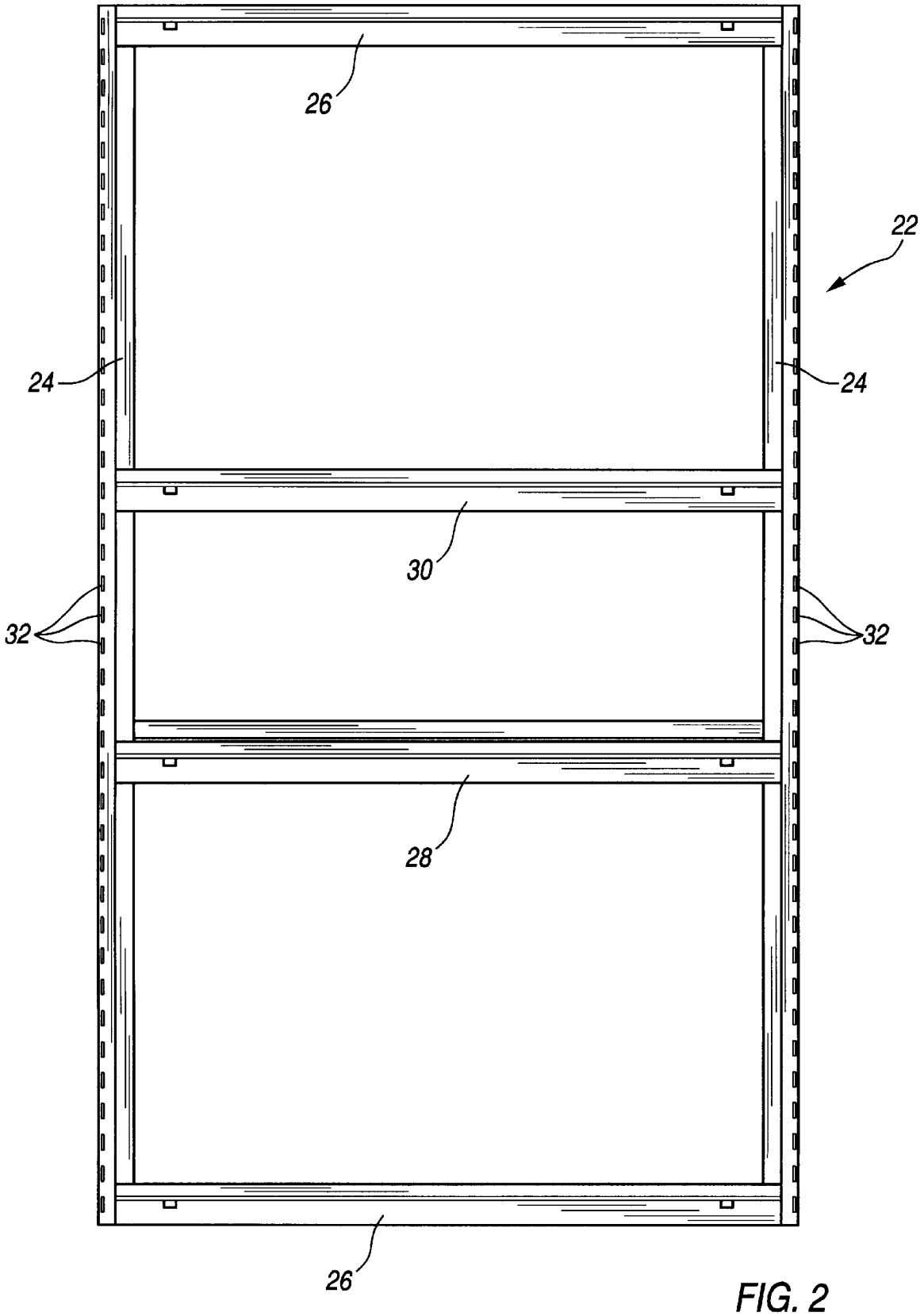
FIG. 2 is a front elevational view of a frame assembly as used in the system of FIG.

Turning to FIG. 2, the panel assemblies 12 can be seen as comprising a rigid frame structure 22 formed from opposed upright members 24 preferably constructed of roll-formed steel or other suitable metal. Connecting the upright members 24 are upper and lower transverse members 26 and intermediate transverse member 28 and 30. The transverse members 26, 28 and 30 may be attached as by welding to the upright members 24. The upright members 24 may be provided with a series of vertical slots 32 suitable for receiving brackets (not shown) that can support shelving, cabinets and other functional devices within the system 10.

Figure 3:
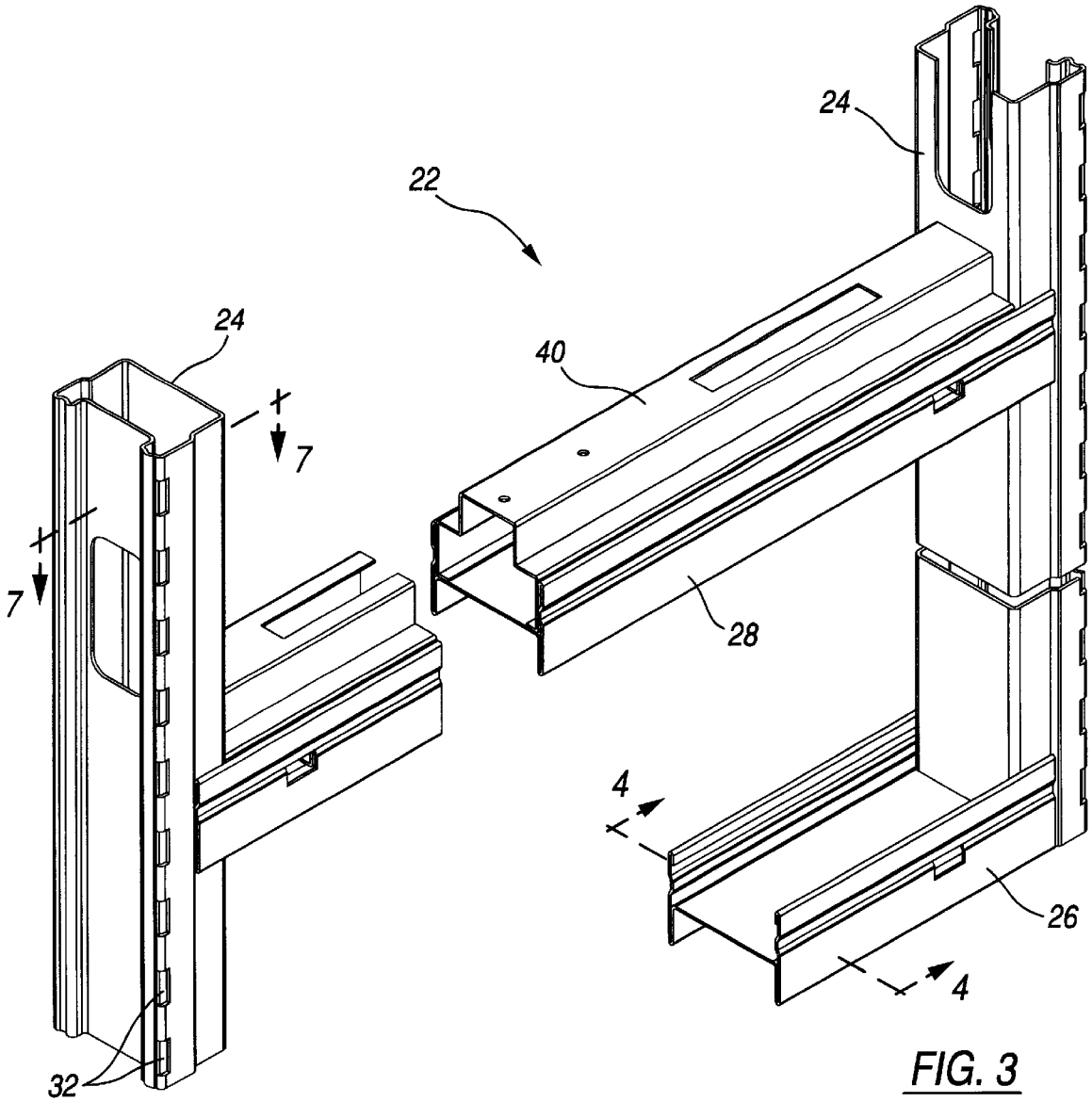
FIG. 3 is a partial side perspective view of the frame assembly of FIG. 2.
Figure 4:
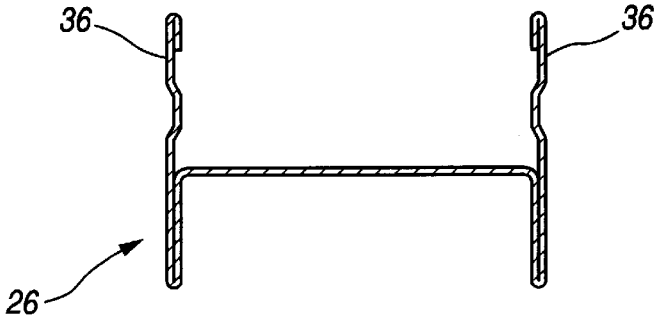
FIG. 4 is a cross-sectional view taken substantially along the line 4—4 of FIG. 3.

FIG. 3 illustrates in enlarged perspective a section of the frame structure 22 showing the transverse frame members 26 and 28 constructed having a generally H-shaped cross-section with upstanding leg portions 36. (See FIG. 4). These members 26 and 28 are advantageously constructed using a roll-form process. Fitted within at least one transverse member 28 is a channel member 40 as will be described hereinafter.

Figure 6:
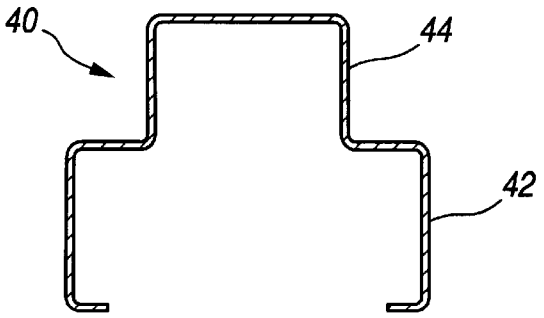
FIG. 6 is a cross-sectional view taken substantially along the line 6—6 of FIG. 5.
Figure 5:
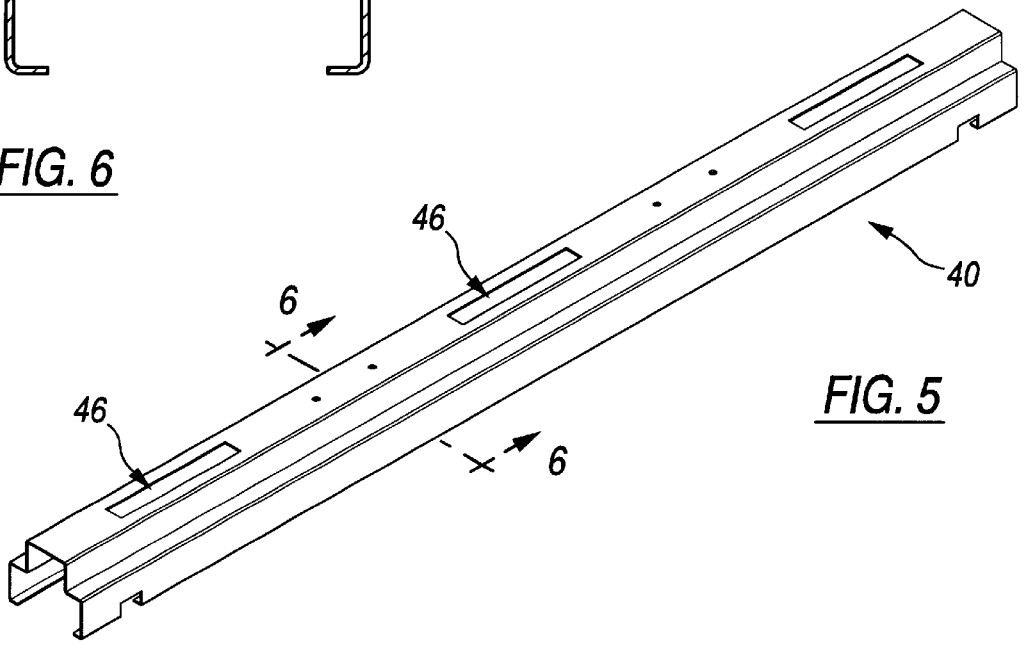
FIG. 5 is a perspective view of a channel member used in constructing the frame assembly.

The channel member 40 is illustrated in detail in FIGS. 5 and 6 and can be seen to include a lower portion 42 and an upwardly projecting portion 44 which is narrower in width than the lower portion 42. The lower portion 42 is dimensioned to fit closely with the upstanding leg portions 36 of the transverse member 28 and may be welded thereto. Suitable openings or slots 46 are formed in the portion 44 for mounting electrical connectors and other electrical devices.

The width of the portion 44 is narrower than the width of the lower portion 42 and thus narrower than the width of the upstanding leg portions 36 of the transverse member 28. As best seen in FIG. 1, a decorative tile 50 may be provided to form a slot 52 in the panel assembly adjacent the narrow portion 44 of the channel member 40. This slot 52 can thereby serve to provide access by cables or wiring to electrical devices mounted or the channel member 40. The upstanding portion 44 of the channel member 40 thereby also creates a light block at the slot 52 without the need for using gaskets of any kind on the adjacent tile 50.

Figure 7:
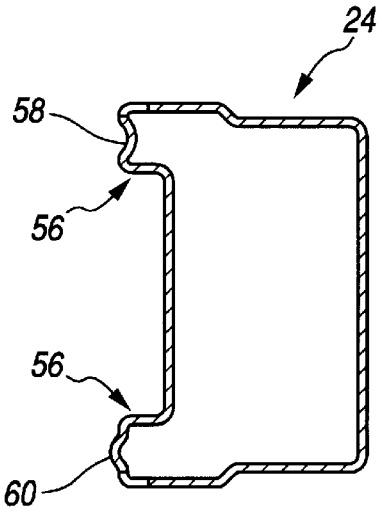
FIG. 7 is a cross-sectional view taken substantially along the line 7—7 of FIG. 3.

A cross-section of one of the vertical upright members 24 is shown in FIG. 7. These members 24 may be readily formed from tubing and are preferably provided with opposed projecting portions 56. The projecting portions 56 are alternatively formed with a concave surface 58 and a convex surface 60. The surfaces 58 and 60 not only serve to properly align adjacent panel assemblies 12, they also serve to form a light block at the joint between the panels 12.

Figure 8:
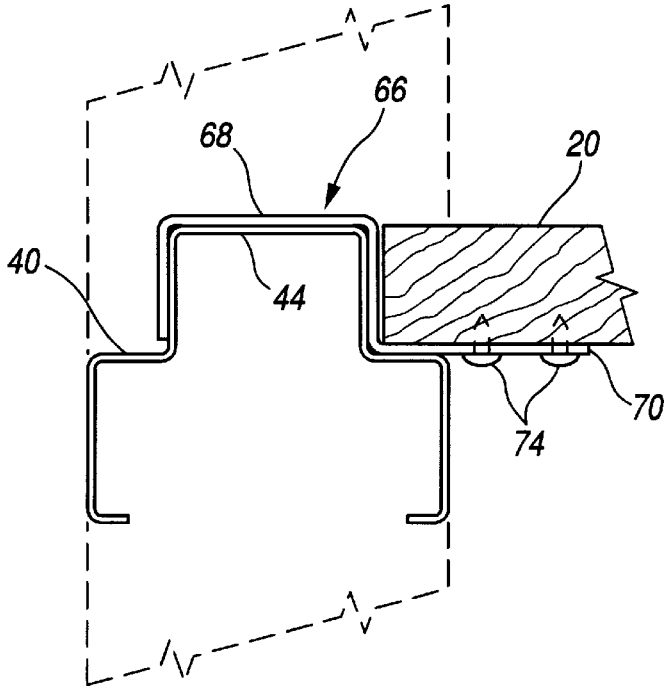
FIG. 8 is an end view of the channel member shown in FIGS. 5 and 6 including an associated bracket member for supporting a work surface.

In accordance with the invention, the channel member 40 may also serve advantageously to provide for the mounting of a bracket 66 as illustrated in FIG. 8. The bracket is formed with a U-shaped end portion 68 which is dimensioned to fit closely over the upstanding portion 44 of the channel member 40. A leg portion 70 of the bracket 66 may extend horizontally outward through the slot 52 in the panel 12 and serve to mount and support a work surface 20 simply using suitable screws 74.

It can now be appreciated that a panel assembly 12 constructed according to the present invention provides a highly functional and sturdy means for creating a variety of office space partition arrangements and is economically constructed using conventional manufacturing techniques. The H-shaped configuration of the transverse members 26, 28 and 30 provides for a highly rigid frame assembly 22. Further, the novel channel member 40 and the cooperation of the channel member 40 and transverse member 28 provides for a highly functional means for accommodating electrical devices while serving the additional function of mounting a work surface 20 to the panels 12.

While the invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A modular wall panel assembly comprising:

a generally rectangular rigid frame assembly comprising a pair of spaced upright members and a plurality of transverse members connecting said upright members, at least one of said transverse members being disposed intermediately between opposed ends of the said upright members;

said at least one generally elongate intermediately disposed member having a generally H-shaped configuration in cross-section defining a pair of spaced upwardly directed leg portions and an upwardly open space between said leg portions; and a generally elongate channel member nesting within said leg portions of said at least one intermediately disposed member and having an upwardly projecting portion which is narrower in width than said at least one intermediately disposed member.

2. The assembly of claim 1 wherein said channel member has a length approximately equal to the length of said at least one intermediately disposed member.

3. They assembly of claim 1 including a plurality of generally planar tiles secured to said frame assembly.

4. The assembly of claim 3 wherein one of said tiles is secured to said frame assembly so as to form a slot in cooperation with an outwardly facing surface of said at least one intermediately disposed member and said slot serves to provide access to an interior region of said frame assembly for accommodating an electrical or communications cable.

5. The assembly of claim 1 including a bracket member having a hook-shaped end portion dimensioned and configured to fit over said projecting portion of said channel member.

6. The assembly of claim 5 wherein said bracket member extends outwardly of said frame assembly and includes means for supporting an end of a work surface.

7. A modular wall panel assembly comprising:

a generally rectangular rigid frame assembly comprising a pair of spaced upright members and a plurality of transverse members connecting said upright members, at least one of said transverse members being disposed intermediately between opposed ends of said upright members;

said at least one generally elongate intermediately disposed member having a generally H-shaped configuration in cross-section defining a pair of spaced upwardly-directed leg portions; and a generally elongate channel member nesting within said leg portions of said at least one intermediately disposed member and having an upwardly projecting portion which is narrower in width than said at least one intermediately disposed member;

said channel member and said at least one intermediately disposed member cooperating to define an interior space;

wherein said projecting portion of said channel member is provided with means for mounting electrical devices.

8. The assembly of claim 7 wherein said means for mounting electrical devices includes slots formed in said projecting portion.

9. A modular wall panel assembly comprising:

a generally rectangular rigid frame assembly comprising a pair of spaced upright members and a plurality of transverse members connecting said upright members, said transverse members defining outwardly facing surfaces;

one of said transverse members being disposed intermediately of opposed ends of said upright members and having a generally H-shaped configuration in cross-section defining an upwardly open space and being fitted with a channel member within said space, said channel member having an upwardly directed projecting portion which is narrower in width than the width of said one transverse member;

said projecting portion of said channel member being provided with means for mounting thereto electrical devices; and a generally planar tile secure to said frame assembly as to form a slot between said tile and an outwardly facing surface of said one transverse member, said slot serving to receive electrical cable for connection to said electrical devices.

10. The assembly of claim 9 including a bracket member received in said slot and connecting to said projecting portion of said channel member, said bracket having means for supporting a work surface.

* * * * *